US008002648B1

(12) United States Patent
Quinn et al.

(10) Patent No.: US 8,002,648 B1
(45) Date of Patent: Aug. 23, 2011

(54) CORKSCREW TEE BALL STAND

(75) Inventors: Charles T Quinn, Dover, MA (US); Joseph B Bowman, Tucson, AZ (US)

(73) Assignee: Franklin Sports, Inc, Stoughton, MA (US)

( * ) Notice: Subject to any disclaimer, the term of this patent is extended or adjusted under 35 U.S.C. 154(b) by 0 days.

(21) Appl. No.: 12/710,789

(22) Filed: Feb. 23, 2010

(51) Int. Cl.
*A63B 69/00* (2006.01)

(52) U.S. Cl. ..... 473/417; 473/451

(58) Field of Classification Search ..... 473/417, 473/423, 428, 429, 386, 387, 419, 430, 451
See application file for complete search history.

(56) References Cited

U.S. PATENT DOCUMENTS

| | | | | | |
|---|---|---|---|---|---|
| 1,608,849 | A | * | 11/1926 | Gilmour | 473/575 |
| 2,884,250 | A | * | 4/1959 | Patterson | 473/423 |
| 2,976,041 | A | * | 3/1961 | White | 473/417 |
| 3,489,411 | A | * | 1/1970 | Morelli et al. | 473/417 |
| 3,767,198 | A | * | 10/1973 | Boyer | 473/423 |
| 4,093,225 | A | * | 6/1978 | Oliver | 473/575 |
| 4,227,691 | A | | 10/1980 | Lefebvre et al. | |
| 4,709,924 | A | | 12/1987 | Wilson et al. | |
| 4,819,937 | A | | 4/1989 | Gordon | |
| 4,886,267 | A | | 12/1989 | Licciardi et al. | |
| 4,976,431 | A | * | 12/1990 | Guenther | 473/417 |
| 5,004,234 | A | | 4/1991 | Hollis | |
| 5,056,781 | A | * | 10/1991 | Preston et al. | 473/423 |
| 5,228,683 | A | * | 7/1993 | Beimel | 473/427 |
| 5,467,978 | A | * | 11/1995 | Paluch | 473/429 |
| 5,505,443 | A | * | 4/1996 | Padilla | 473/417 |
| 5,531,438 | A | * | 7/1996 | Corley | 473/429 |
| 5,540,430 | A | | 7/1996 | Nichols et al. | |
| 5,611,539 | A | * | 3/1997 | Watterson et al. | 473/197 |
| 6,045,462 | A | | 4/2000 | Mourek | |
| 6,099,418 | A | | 8/2000 | Owen | |
| 6,238,307 | B1 | | 5/2001 | Owen | |
| 6,296,582 | B1 | * | 10/2001 | Minniear | 473/428 |
| 6,358,163 | B1 | | 3/2002 | Tanner | |
| 6,458,037 | B1 | * | 10/2002 | Dixon, Jr. | 473/219 |
| 6,551,204 | B1 | | 4/2003 | Di Re | |
| 6,682,445 | B1 | | 1/2004 | Tanner | |
| 6,695,723 | B2 | | 2/2004 | Leal et al. | |
| 6,884,185 | B2 | | 4/2005 | Udwin et al. | |
| 6,979,273 | B2 | | 12/2005 | Tsai | |
| 7,063,632 | B2 | | 6/2006 | Green | |
| 7,182,705 | B2 | | 2/2007 | Lin | |
| 7,226,372 | B2 | | 6/2007 | Flanigan | |
| 7,226,373 | B2 | * | 6/2007 | Arenas | 473/417 |

* cited by examiner

*Primary Examiner* — Mitra Aryanpour
(74) *Attorney, Agent, or Firm* — Joseph B Bowman

(57) ABSTRACT

A tee ball stand with an adjustable length ball support stanchion having an anchor connection fitting on the lower end thereof, and a ground penetrating corkscrew anchor equipped with a stanchion connection fitting on the upper end thereof. The anchor connection fitting of the stanchion may be frictionally coupled to the stanchion connection fitting to hold the stanchion in an upright orientation to receive a ball on the upper end thereof. The ground penetrating corkscrew anchor prevents displacement of the tee ball stand in the event the stanchion is struck by an errant bat swing.

5 Claims, 5 Drawing Sheets

CORKSCREW TEE BALL STAND

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a tee ball stand. More specifically, this invention relates to a tee ball stand which is securely fixed to the ground to resist displacement when the ball holding structure is inadvertently struck instead of the ball itself.

Tee ball stands are characteristically used in the process of teaching young children to hit a ball with a bat. The typical tee ball stand comprises a flat, ground engaging plate, many times in the shape of a baseball home plate, which supports an adjustable vertical pole having a ball support cup on the upper end. A ball is placed on the support cup so a youngster can then strike at the stationary ball by swinging a bat instead of the more difficult task of attempting to hit a moving ball. With limited experience or limited coordination, the youngster may occasionally strike the pole holding the ball, rather than the ball itself. This can be expected as part of the learning process. As a result, however, the tee ball stand is frequently tipped over or moved and has to be repositioned for the training session to continue. This can be a source of frustration and discouragement, as well as a safety concern, for the youngster and coach in the event of inadvertent contact with errant bat swings.

U.S. Pat. Nos. 4,227,691, 4,709,924, 4,819,937, 5,004,234 and 6884185, as well as others, are characteristic of various tee ball practice devices having a base plate that rests flat on the ground to support some type of ball holding apparatus.

Therefore, a need remains in the field of youth sports for a safe tee ball stand that can be easily and quickly fixed to the ground and remain so fixed when inadvertently struck with a bat. The primary objective of this invention is to meet this need.

SUMMARY OF THE INVENTION

More specifically, an object of the invention is to provide a lightweight tee ball stand that will yield from an upright orientation in the event it is struck with an errant bat of a youngster so as to protect the user from experiencing the shock of impact, but, at the same time, the tee ball stand will remain fixed at a preselected location on the ground.

Another object of the invention is to provide a tee ball stand with a corkscrew ground anchor to prevent the tee ball stand from being knocked over or displaced when struck by an errant blow of a bat.

Yet another object of the invention is to provide a tee ball stand of the character described including an installation tool to quickly and easily cause the corkscrew ground anchor to penetrate the ground.

A further object of the invention is to provide a tee ball stand of the character described whereby the ground anchor may be left in the ground and the upright stanchion may be easily removed when not in use.

A corollary object of the invention is to provide a tee ball stand of the character described whereby in one embodiment the ground anchor is completely flush with the ground in order to eliminate a tripping hazard when the upright stanchion is removed from the ground anchor.

A further object of the invention is to provide a tee ball stand of the character described which may be quickly and easily installed or uninstalled for storage.

In summary, an object of the invention is to provide a tee ball stand with an adjustable length ball support stanchion having an anchor connection fitting on the lower end thereof, and a ground penetrating corkscrew anchor equipped with a stanchion connection fitting on the upper end thereof. The anchor connection fitting of the stanchion may be frictionally coupled to the stanchion connection fitting to hold the stanchion in an upright orientation to receive a ball on the upper end thereof. The ground penetrating corkscrew anchor prevents displacement of the tee ball stand in the event the stanchion is struck by an errant bat swing.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Referring to the first embodiment of the invention in greater detail, attention is directed to FIGS. 1-4. The tee ball stand includes an upright ball support stanchion, generally designated by the numeral 10, connected to a ground penetrating anchor, generally designated by the numeral 12, to hold the stanchion 10 in a substantially vertical orientation perpendicular to the ground 14.

The stanchion 10 is preferably molded from a synthetic material such as rubber or plastic compounds having some resiliency so that the length of the stanchion 10 is somewhat yieldable when struck with an errant bat swing.

Figure 1:
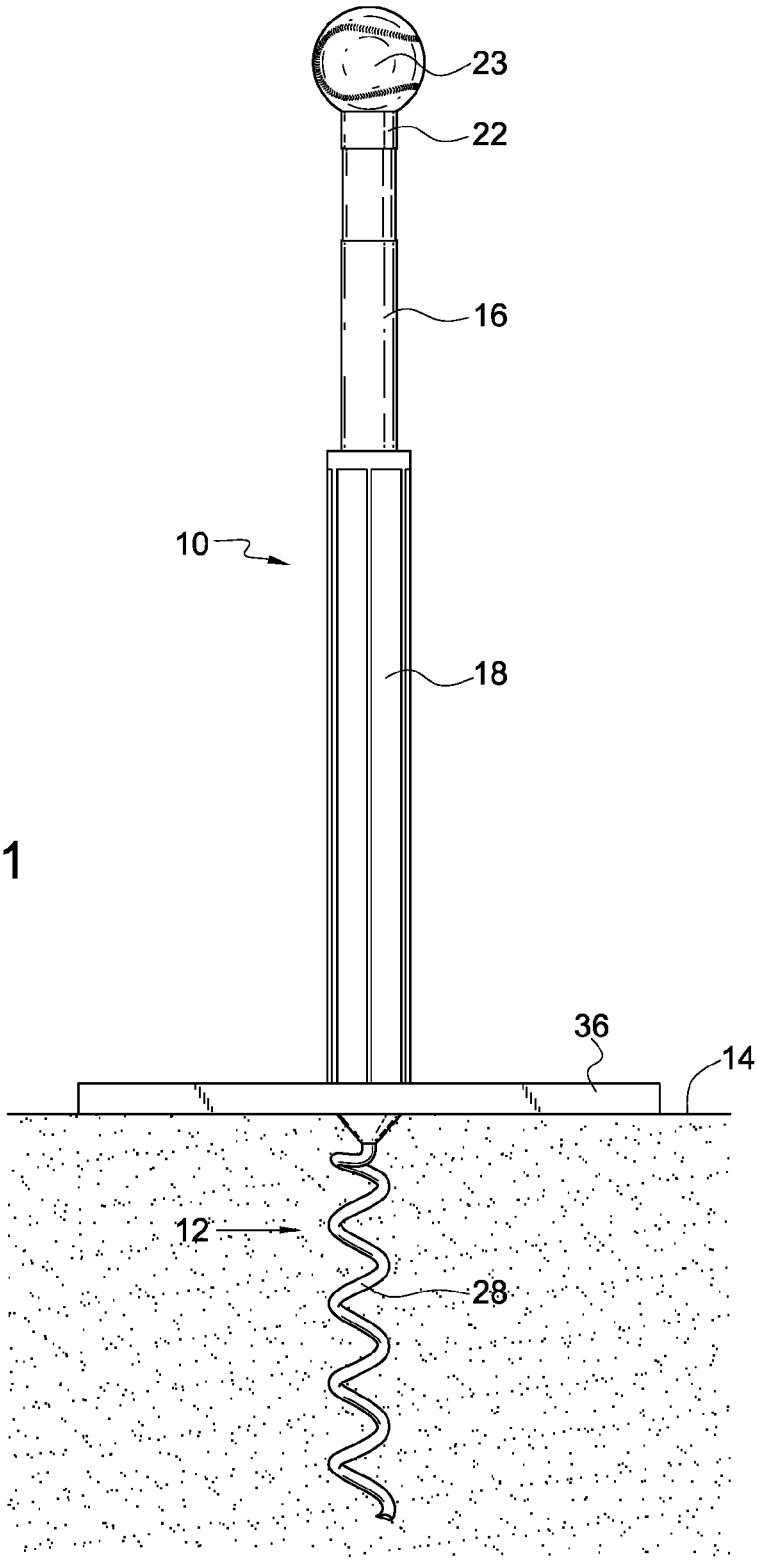
FIG. 1 is a side elevational view of a corkscrew tee ball stand constructed in accordance with one embodiment of the invention.
Figure 2:
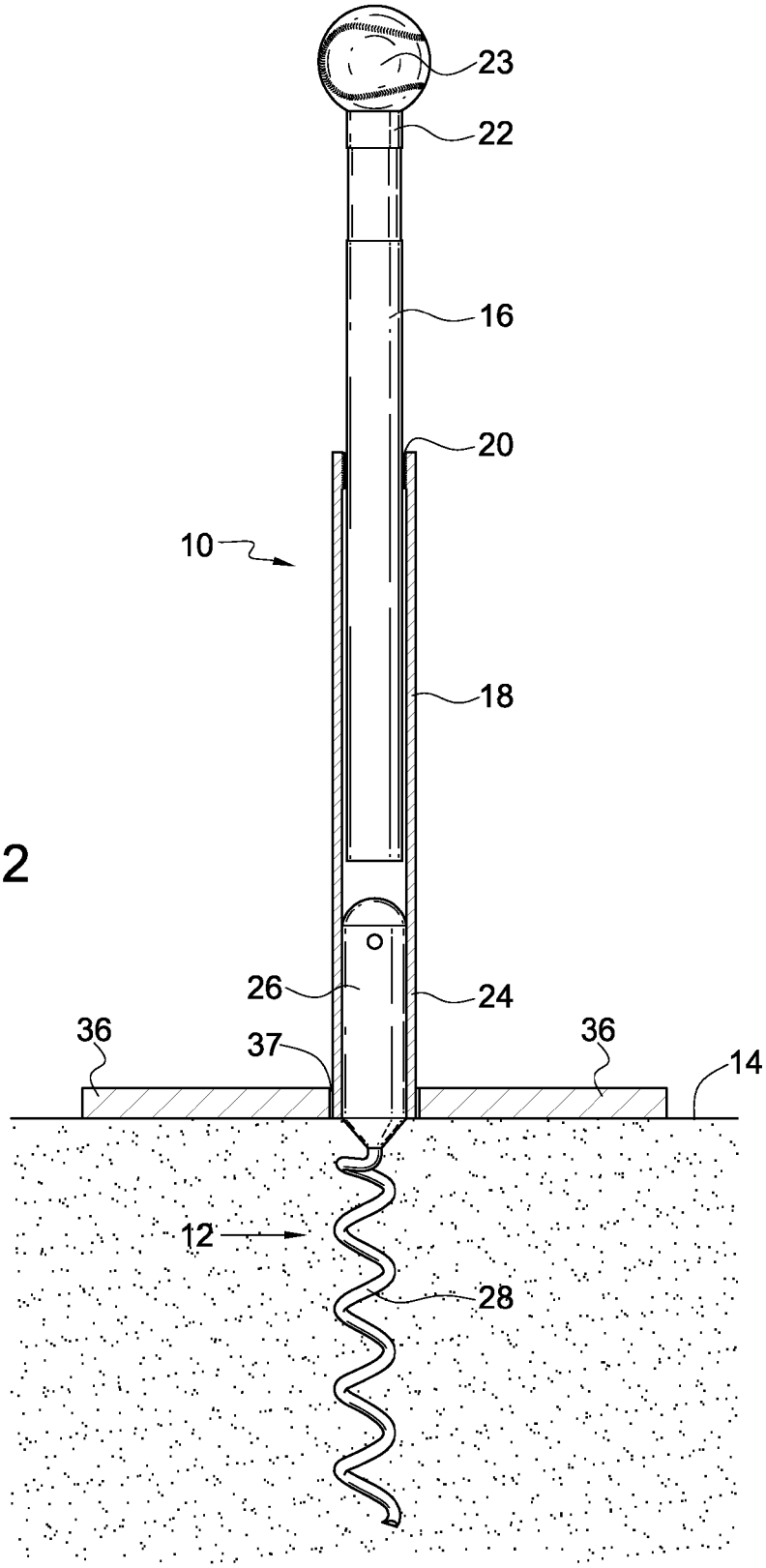
FIG. 2 is a side elevational view similar to FIG. 1 but showing the lower tube of the stanchion in section to better illustrate the details of construction.

As best understood with reference to FIG. 2, the stanchion 12 includes an upper pipe section 16 telescopically received in a lower pipe section 18 to permit the overall height of the stanchion 12 to be adjusted in accordance with the stature of the batter using the equipment. Friction pad 20 interiorly of the upper end of the lower pipe section 18 grips the upper pipe section 16 to maintain the adjusted height of the stanchion 12.

At the upper end of the upper pipe section 16 is a ball support cup 22 on which may be placed a conventional tee ball or baseball 23.

The lowermost end of the lower pipe section 18 of the stanchion 10 terminates as an anchor connection fitting 24 in the form of a tubular extension of lower pipe section 18 having a uniform interior diameter. The anchor connection fitting 24 receives in frictional engagement a molded cylindrical plug or projection 26 of the ground penetrating anchor 12. In order to achieve a snug fit between the cylindrical projection 26 and the anchor connection fitting 24, the projection 26 has a diameter substantially equal to the interior diameter of the anchor connection fitting 24.

Figure 3:
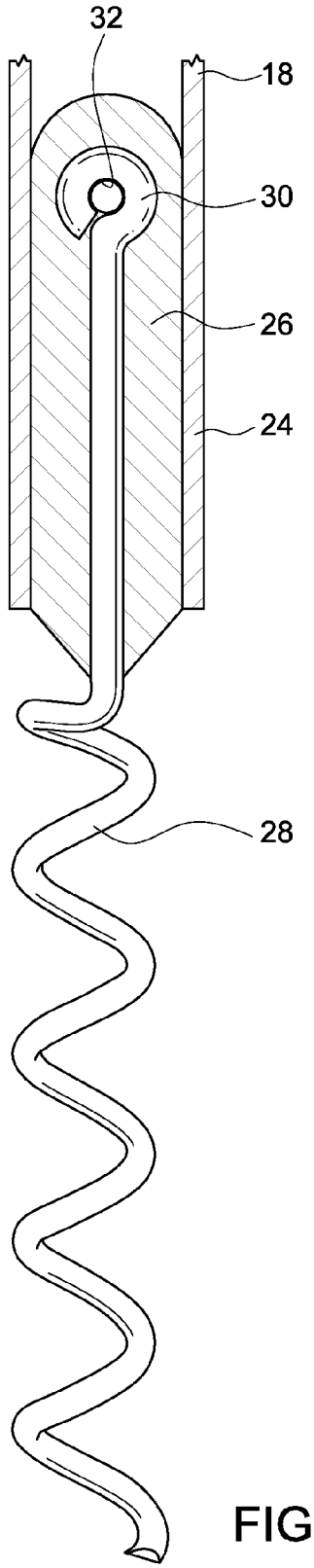
FIG. 3 is an enlarged fragmentary view of the ground engaging anchor of the corkscrew tee ball stand.
Figure 4:
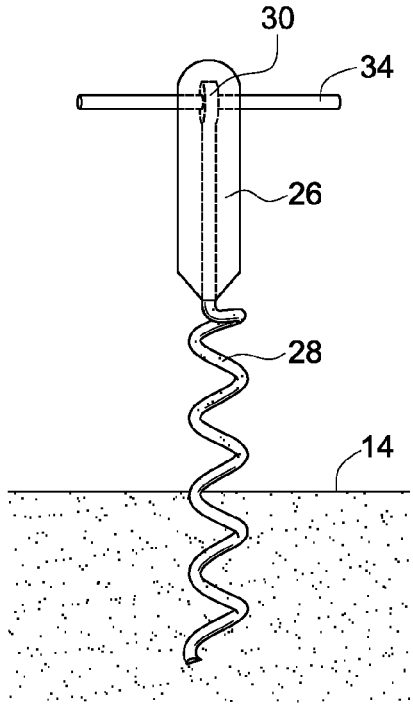
FIG. 4 is a side elevational view illustrating the installation of the ground engaging anchor of the corkscrew tee ball stand.

As best shown in FIG. 3, the cylindrical projection 26 of the ground penetrating anchor 12 is molded around the upper shank of a corkscrew auger 28. The upper shank of the corkscrew auger 28 terminates with an eyelet 30 embedded within the cylindrical projection 26. A lateral hole 32 through the cylindrical projection 26 registers with the inside diameter of the eyelet 30. As illustrated in FIG. 4, an installation tool in the form of a cylindrical rod or crossbar 34 may be inserted through the hole 32 in the cylindrical projection and through the inside diameter of the eyelet 30. So positioned, the installation crossbar 34 may be used as a mechanical lever to facilitate penetration of the ground 14 by the corkscrew auger 28.

In operation, therefore, the ground anchor 12 is first twisted into the ground 14 with the aid of the installation crossbar 34 as previously described so that the cylindrical projection 26 extends about ground 14. The stanchion 10 is then installed on the ground anchor 12 by inserting the anchor connection fitting 24 over the cylindrical projection 26. Lastly, an optional home base plate 36 having a central hole 37 therethrough may be slipped over the stanchion 10 to rest on the ground 14 in order to better simulate the batting region of a baseball diamond.

Figure 5:
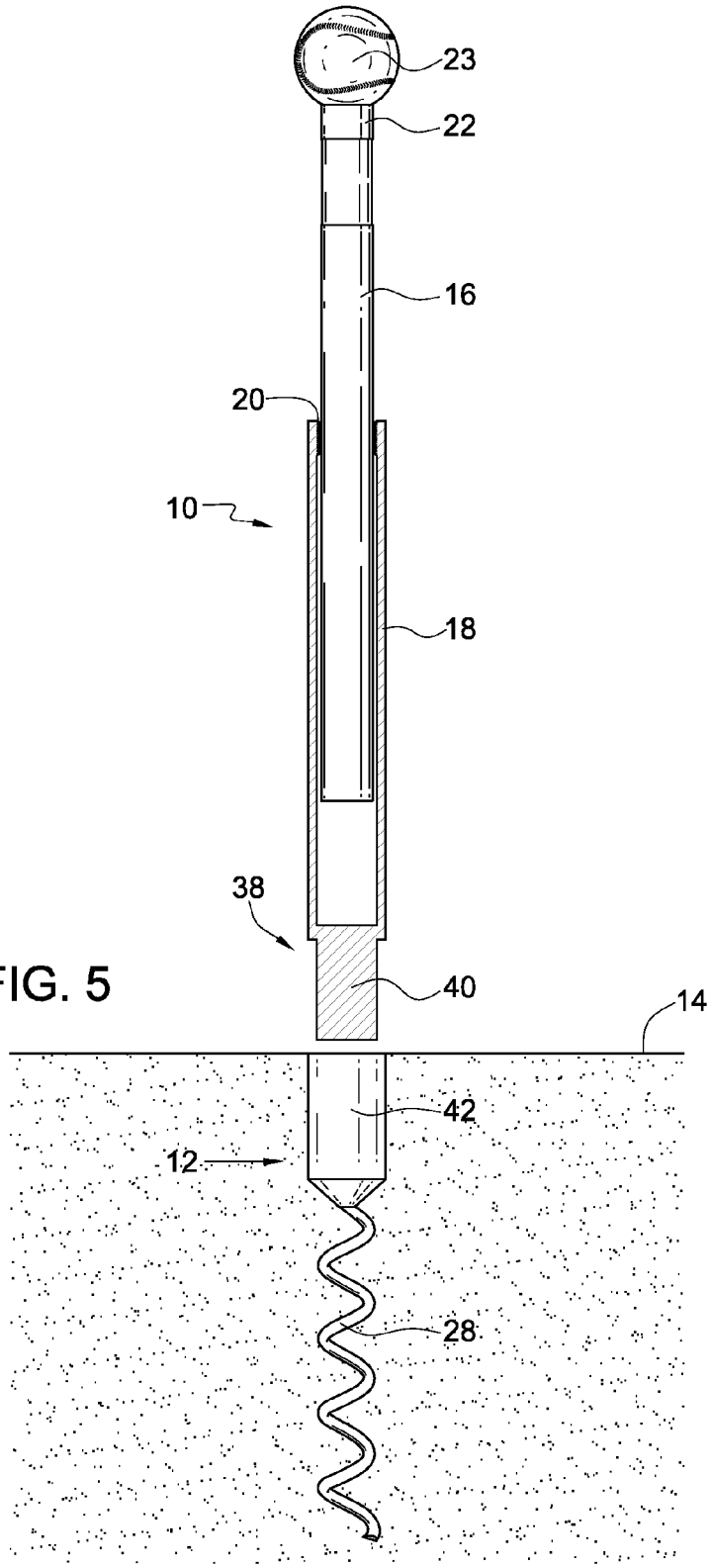
FIG. 5 is a side elevational view, partially sectional, of a corkscrew tee ball stand constructed in accordance with a second embodiment of the invention.
Figure 6:
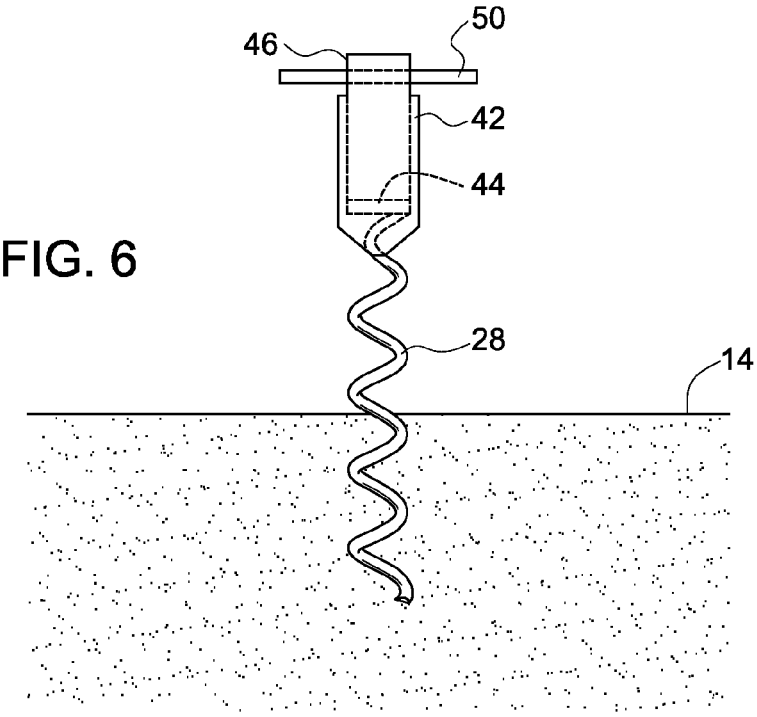
FIG. 6 is a side elevational view illustrating the installation of the ground engaging anchor of the second embodiment of the corkscrew tee ball stand.
Figure 7:
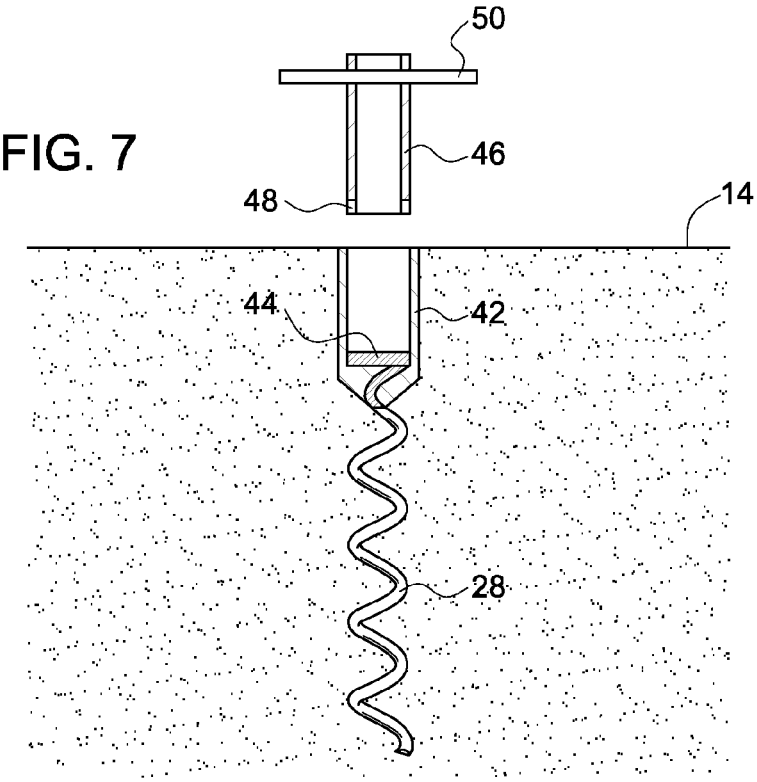
FIG. 7 is a view similar to that of FIG. 6 but illustrating the installation tool withdrawn from the ground engaging anchor.

Referring to the second embodiment of invention in greater detail, attention is now directed to FIGS. 5-7 of the drawings. The same reference numerals are utilized for the like features found in the first embodiment previously described.

The tee ball stand includes an upright ball support stanchion, generally designated by the numeral 10, connected to a ground penetrating anchor, generally designated by the numeral 12, to hold the stanchion 10 in a substantially vertical orientation perpendicular to the ground 14.

The stanchion 12 includes an upper pipe section 16 telescopically received in a lower pipe section 18 to permit the overall height of the stanchion 12 to be adjusted in accordance with the stature of the batter using the equipment. Friction pad 20 interiorly of the upper end of the lower pipe section 18 grips the upper pipe section 16 to maintain the adjusted height of the stanchion 12. At the upper end of the upper pipe section 16 is a ball support cup 22 on which may be placed a conventional tee ball or baseball 23. An optional home base plate (not shown) may be inserted over the stanchion 12 to simulate a conventional batting zone.

The lowermost end of the lower pipe section 18 of the stanchion 10 terminates as an anchor connection fitting 38 in the form of a cylindrical projection 40 having a uniform outside diameter. The cylindrical projection 40 of the anchor connection fitting 38 mates within the stanchion connection 12 molded as a socket 42 having an inner diameter substantially equal to the outside diameter of the cylindrical projection 40 to provide a tight friction fit therewith.

As best shown in FIG. 7, the socket 42 of the ground penetrating anchor 12 is molded around the upper shank of a corkscrew auger 28. The upper shank of the corkscrew auger 28 is formed as a crossbar 44 which is exposed and lies along a diameter in the bottom of the socket 42.

The installation tool associated with the ground anchor 12 of the second embodiment is illustrated in FIGS. 6&7. The installation tool includes a cylindrical torque driver head 46 having an outside diameter substantially equal to the inner diameter of the socket 42. A pair of notches 48 is cut in the lower end of the driver head 46 and is sized to receive the crossbar 44 of the corkscrew auger 28 in the bottom of the socket 42. The upper end of the driver head 46 is equipped with a handle 50 to facilitate rotational twisting when the driver head 46 is inserted into the socket 42 for rotationally penetrating the ground with the corkscrew auger 28. In the latter regard, it is important that the driver head 46 be substantially the same diameter as the inner diameter of the socket 42 so that the walls of the socket 42 do not collapse as the ground anchor 12 is screwed into the ground 14 because the objective is to penetrate the ground sufficiently such that the upper end of the socket 42 is flush with the ground level.

In operation, therefore, the ground anchor 12 is first twisted into the ground 14 with the aid of the installation tool as previously described so that the socket 42 is flush with the ground 14. The stanchion 10 is then installed on the ground anchor 12 by inserting the cylindrical projection 40 of the anchor connection fitting 38 into the socket 42 of the ground anchor 12. The stanchion 10 may be easily removed from its frictional engagement with ground anchor 12 for temporary storage between uses. The ground anchor 12 may be left installed in the ground 14 without presenting a tripping hazard to passersby. Alternatively, the ground anchor 12 may be easily removed by use of the installation tool disclosed by reversely rotation to back the corkscrew anchor 28 from the ground 14.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

We claim:

1. A tee ball stand comprising:

an upright stanchion having upper and lower ends and, when in use, having an intended orientation substantially perpendicular to the ground;

a ball supporting member at the upper end of said stanchion;

an anchor connection fitting at the lower end of said stanchion, said anchor connection fitting being formed as a tubular end structure having an inner diameter;

a ground anchor base including a ground penetrating corkscrew member having upper and lower ends, and a stanchion connection fitting securely attached to the upper end of said corkscrew member, said stanchion connection fitting being molded to the upper end of said corkscrew member as a cylindrical projection having an outside diameter substantially the same as said inner diameter of said anchor connection fitting, said upper end of said corkscrew member formed as an eyelet embedded within the cylindrical projection of said stanchion connection fitting, said cylindrical projection having an axial hole therethrough registering with said eyelet; and a cross bar installation tool to removable fit through said axial hole in said cylindrical projection and through said eyelet of said corkscrew member in order to provide mechanical advantage for installing said ground anchor base into the ground;

whereby with said ground penetrating corkscrew member embedded into the ground, said cylindrical projection of said stanchion connection fitting projects above ground to receive in friction fitting relationship said tubular end structure of said anchor connection fitting to hold said stanchion is a substantially upright position to receive a ball on said ball supporting member.

2. The tee ball stand as in claim 1, said stanchion including first and second sections telescopingly fitted together whereby the overall length of said stanchion may be adjustably varied to present said ball supporting member at the upper end of said first section at a preselected height above said base being connected to said anchor connection at the lower end of said second section of said stanchion.

3. The tee ball stand as in claim 1, said stanchion being molded of a yieldable synthetic material.

4. The tee ball stand as in claim 1 further including a home base plate with a hole therethrough to permit said plate to slip over said stanchion and overlie the ground to simulate home base and to provide a reference for the batter.

5. A tee ball stand comprising:

an upright stanchion having upper and lower ends and, when in use, having an intended orientation substantially perpendicular to the ground;

a ball supporting member at the upper end of said stanchion;

an anchor connection fitting at the lower end of said stanchion, said anchor connection fitting being formed as a cylindrical projection having an outside diameter;

a ground anchor base including a ground penetrating corkscrew member having upper and lower ends, and a stanchion connection fitting securely attached to the upper end of said corkscrew member, said stanchion connection fitting being molded to the upper end of said corkscrew member and having a tubular pocket with an inner diameter substantially the same as said outside diameter of said anchor connection fitting, said upper end of said corkscrew member formed as a crossbar in the bottom of said tubular pocket of said stanchion connection fitting; and an installation tool having a cylindrical head with an outside diameter substantially equal to the inner diameter of said tubular pocket, driver notches cut in the cylindrical head to register with and receive said crossbar in the bottom of said tubular pocket, and a crossbar handle connected to said cylindrical head in order to provide mechanical advantage for installing said ground anchor base into the ground;

whereby with said ground penetrating corkscrew member embedded into the ground, said tubular pocket of said stanchion connection fitting is flush with the ground to receive in friction fitting relationship said cylindrical projection of said anchor connection fitting to hold said stanchion is a substantially upright position to receive a ball on said ball supporting member.

* * * * *